United States Patent [19]

Mullen, Jr.

[11] 3,995,549

[45] Dec. 7, 1976

[54] ROCKET/MISSILE MOTOR EXPLOSIVE INSERT DETONATOR

[75] Inventor: Arthur L. Mullen, Jr., King George County, Va.

[73] Assignee: The United States of America as represented by the Secretary of the Navy, Washington, D.C.

[22] Filed: Mar. 17, 1975

[21] Appl. No.: 559,281

[52] U.S. Cl. ..... 102/56 SC

[51] Int. Cl.[2] ..... F42B 13/12; F42B 13/28

[58] Field of Search ..... 102/24 HC, 56 SS, 67

[56] References Cited

UNITED STATES PATENTS

| | | | |
|---|---|---|---|
| 2,595,960 | 5/1952 | Lawrence | 102/24 HC |
| 3,092,025 | 6/1963 | Hradel et al. | 102/24 HC |
| 3,180,264 | 4/1965 | Webb | 102/24 HC |
| 3,384,016 | 5/1968 | Blanchard, Jr. | 102/49.5 |
| 3,572,249 | 3/1971 | Davis | 102/67 |

FOREIGN PATENTS OR APPLICATIONS

| | | | |
|---|---|---|---|
| 2,307,581 | 8/1974 | Germany | 102/56 SC |

*Primary Examiner*—Verlin R. Pendegrass
*Attorney, Agent, or Firm*—R. Sciascia; R. Beers; S. Sheinbein

[57] ABSTRACT

A detonator for detonating the unfired motor charge when the warhead charge of a rocket missile explodes. The detonator comprises an insert comprising a pair of frusto-cones in parallel relationship, the sides being sealed to each other at the base end and open at the apical end so that the space between the sides can be filled with explosive before the opening is closed. The insert is placed on top of the motor head plate and below the warhead base plate with its concave side facing the motor head plate.

3 Claims, 4 Drawing Figures

ROCKET/MISSILE MOTOR EXPLOSIVE INSERT DETONATOR

BACKGROUND OF THE INVENTION

This invention relates to rocket missiles and especially to a rocket motor detonator device.

The rocket motor of a rocket missile carries a sufficient load of propellant to drive the missile to the extreme of its range. The ratio of the weight of the warhead explosive to the rocket motor propellant may be of the order of 1:6, for example. If the missile is not used at its extreme range, a substantial amount of unused motor propellant may be available for use as an explosive to enhance the blast capability of the rocket missile. To date, no means of detonating the unused portion of the motor propellant has been available.

SUMMARY OF THE INVENTION

The objects and advantages of the present invention are accomplished by employing an insert between the head of the rocket motor and the warhead charge. The insert is hollow, is packed with explosive and is shaped so as to focus explosive energy into the rocket motor.

An object of this invention is to automatically detonate any unused rocket motor propellant when a rocket missile warhead charge detonates.

Other objects, advantages and novel features of the present invention will become apparent from the following detailed description of the invention when considered in conjunction with the accompanying drawing.

DETAILED DESCRIPTION OF THE INVENTION

Figure 1:
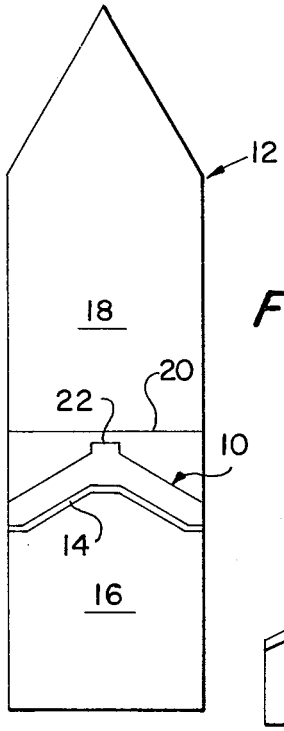
FIG. 1 is a schematic side view of a rocket missile with an embodiment of the invention in place.

FIG. 1 shows a detonator insert 10 for a rocket missile 12, in side view. The detonator insert 10 is in place on the head plate 14 of the rocket motor. The central portion 16 of the rocket motor is filled with grains of propellant (not shown). The fore part of the rocket is filled with explosive charge in the portion marked generally with the numeral 18. The base plate 20 of the warhead lies quite near the nearest part 22 of the detonator 10.

Figure 3:
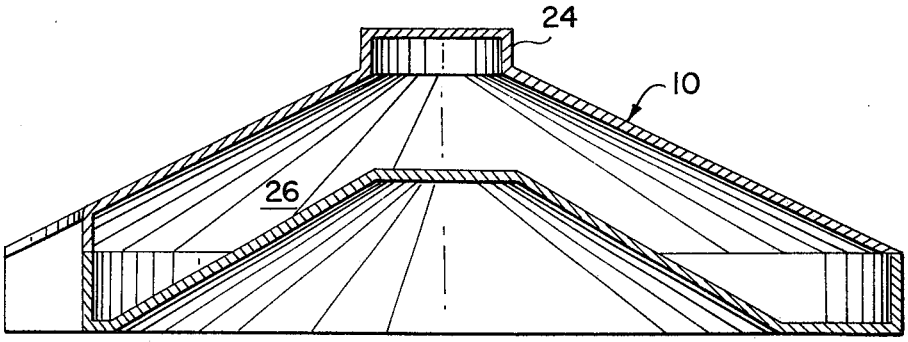
FIG. 3 is a side view of the embodiment shown in FIG. 2.
Figure 2:
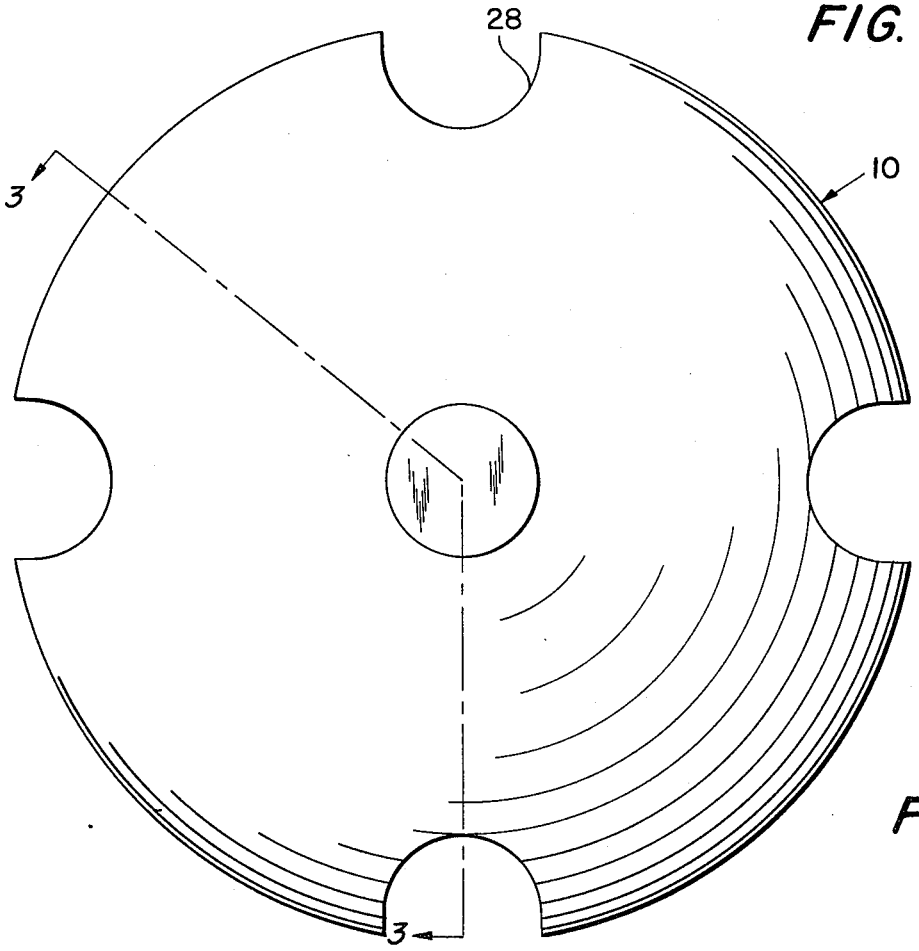
FIG. 2 is a top view of an embodiment of the invention.

A top view of the detonator insert 10 is presented in FIG. 2 and a side view in FIG. 3. The detonator insert 10 is generally conical in shape with a cylindrical portion, or pillbox, 24 on the top or apical side. The pillbox portion is open at the top and, of course, at the bottom. The detonator insert 10 may be thought of as a pair of frusto-cones whose conical sides are parallel and spaced from each other, i.e., a pair of frusto-cones "in parallel relationship," the two sides being sealed to each other at the bottom or base of the frustums.

The detonator insert 10 is preferably formed from fiberglass, typically about 3/32 inch thick. Any rigid, shatterable material, such as aluminum, could be used.

Semicircular holes 28 are cut from the periphery of the detonator to allow it to fit around bosses which protrude from the head plate 14 of the rocket motor. If the motor has no bosses, these would not be necessary. The holes are only used to provide a snug fit between the detonator insert and the head plate of the motor. Different hole locations might be necessary for different missiles.

Figure 4:
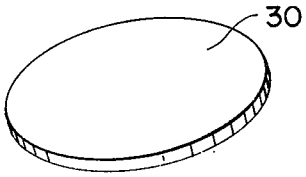
FIG. 4 is a pictorial illustration of the closure element.

The detonator insert 10 has a hollow volume 26 which is filled with an explosive material, or charge, (not shown) through the pillbox 24. When filling is complete, the explosive is covered by a thin plastic or metal cover 30 shown in FIG. 4. The detonator insert 10 has now become a detonator.

In operation, when the main explosive charge in the warhead is detonated, the charge in the detonator is detonated sympathetically by the shock wave. The explosive energy of the detonator charge is focused by the conical shape of the charge forcing a jet of hot metal particles from the rocket motor head plate into the propellant. The shock wave separates the propellant grains into small particles which are detonated by the impact of the hot metal jet. The result is a greatly enhanced explosive effect, the exact amount depending on the amount of unused rocket motor propellant.

Obviously, many modifications and variations of the present invention are possible in light of the above teachings. It is therefore to be understood that, within the scope of the appended claims, the invention may be practiced otherwise than as specifically described.

What is claimed is:

1. A rocket detonator insert initiated by sympathetic detonation from a warhead for exploding unburned rocket motor propellant grains to enhance the destructive effect of the warhead comprising:

a head plate separating a rocket into a warhead portion and a rocket motor portion, said head plate formed in a frusto-conical shape with its apical side facing said warhead portion and the base side in contact with an inner wall portion of said rocket, a pair of frusto cones one inside of and spaced from the other in parallel relationship, the two sides being parallel to each other at the bottom to form a hollow chamber between the sides and having the inside frusto cone of said pair of frusto cones positioned in intimate contact with said head plate, a charge of explosive filling said hollow chamber to form single shaped chamber member having a diameter dimension equal to said head plate diameter dimension;

whereby the charge of explosive is ignited by sympathetic detonation from the warhead to generate a shock wave that separates the unburned propellant grains into small particles that detonate on impact of hot metal particles caused by disintegration of the headplate.

2. A detonator insert as in claim 1, said insert further having a tubular element mounted on the apical end of the outer one of said frusto-cones.

3. A detonator as in claim 1, further having a tubular element mounted on the apical end of the outer one of said frusto-cones and a closure element for closing the free end of said tubular element.

* * * * *